US010493503B2

(12) United States Patent
Rutks

(10) Patent No.: US 10,493,503 B2
(45) Date of Patent: Dec. 3, 2019

(54) METHOD, SUBSTRATE AND ARRANGEMENT FOR A PARTICLE COLLECTION AND A SUBSEQUENT PARTICLE CLEANING

(71) Applicant: Reinhold Karl Rutks, Hagersten (SE)

(72) Inventor: Reinhold Karl Rutks, Hagersten (SE)

( * ) Notice: Subject to any disclaimer, the term of this patent is extended or adjusted under 35 U.S.C. 154(b) by 897 days.

(21) Appl. No.: 14/415,739

(22) PCT Filed: Jul. 18, 2013

(86) PCT No.: PCT/SE2013/050918
§ 371 (c)(1),
(2) Date: Jan. 20, 2015

(87) PCT Pub. No.: WO2014/014406
PCT Pub. Date: Jan. 23, 2014

(65) Prior Publication Data

US 2015/0174623 A1 Jun. 25, 2015

(30) Foreign Application Priority Data

Jul. 19, 2012 (SE) ..... 1200446

(51) Int. Cl.
*B08B 6/00* (2006.01)
*B03C 7/08* (2006.01)

(52) U.S. Cl.
CPC . *B08B 6/00* (2013.01); *B03C 7/08* (2013.01)

(58) Field of Classification Search
None
See application file for complete search history.

(56) References Cited

U.S. PATENT DOCUMENTS 4,455,187 A * 6/1984 von Blucher ..... A62B 23/00 156/277
5,204,041 A * 4/1993 Tashiro ..... D01D 5/12 264/177.13

(Continued)

FOREIGN PATENT DOCUMENTS

| | | |
|---|---|---|
| DE | 4016089 A1 | 11/1991 |
| EP | 0090073 | 10/1983 |
| FR | 2765502 | 1/1999 |

OTHER PUBLICATIONS

English Translation FR2765502, accessed on Dec. 2017. (Year: 1997).*

(Continued)

*Primary Examiner* — Eric W Golightly
*Assistant Examiner* — Arlyn I Rivera-Cordero
(74) *Attorney, Agent, or Firm* — Young & Thompson

(57) ABSTRACT

A method, substrate and arrangement for creating a particle collection and/or a particle cleaning of a surface part supporting loose or loosened particles. A piece of flexible sheet material, adapted to, via an electrostatic field strength, collect loose and/or loosened particles, and a support layer tightly cooperating with and supporting the piece of flexible sheet material, where both the piece and support layer are adapted to be air permeable for a cleansing of the particles within the piece of flexible sheet material. A use of generated air streams shall, under an overpressure and/or an underpressure, be allowed to pass through the substrate, in a deionized state, in a direction through the support layer and the piece of flexible sheet material. The piece of flexible sheet material forms a filter unit which is adapted at least for collecting of micro- and nano particles and activatable under an electrostatic field strength.

11 Claims, 3 Drawing Sheets

(56) References Cited

U.S. PATENT DOCUMENTS

| | | | | |
|---|---|---|---|---|
| 5,490,300 | A | 2/1996 | Horn | |
| 2004/0163667 | A1 | 8/2004 | Learman | |
| 2011/0138558 | A1* | 6/2011 | Favaqgrossa | A46B 13/005 15/160 |
| 2013/0019419 | A1* | 1/2013 | Favagrossa | B60S 3/002 15/53.1 |

OTHER PUBLICATIONS

International Search Report, dated Dec. 2, 2013, from corresponding PCT application.

* cited by examiner

"U1"
S1
~
S2
(=)
T
"Ur"
"Ir"
33
S3
(~)
34

61
61a
61b
62
62a
62b
"p2"
2c'
70
"p2"
2c
"d1"
40a
2c
"p2"

20
41
30a
"p2"
35'
30b
30c
30c'
35
42
41'
"p2"
"p2"
43
34
40'

42
42b
42c
42c'

METHOD, SUBSTRATE AND ARRANGEMENT FOR A PARTICLE COLLECTION AND A SUBSEQUENT PARTICLE CLEANING

THE TECHNICAL FIELD OF THE INVENTION

In general, the invention relates to a method, a substrate and an arrangement for creating a particle collection and a subsequent particle cleaning of loose and/or loosened particles, distributed along a part of a surface.

A purpose of the invention is to be able to collect and clean a substrate from inter alia small particles, falling within the micro field and/or the nano field, and which collection will take place by the use of a generated electrostatic field and its field intensity, generated by the use of one or several ionizing electrodes, alternatively the said cleaning is to be activated by using one or several deionization electrodes.

Hence, the present invention at its core builds upon the exploitation of a generated electrostatic field with a selected field intensity or a neutralized field intensity to "0".

In an explanatory purpose, the following description firstly comprises the method itself, secondly comprises a substrate and thirdly comprises the arrangement itself.

Hence, the present invention comprises a method, which uses a substrate and an ionization electrode to, within a first process step, via an electrostatic field and a field intensity, collect loose and/or loosened particles from one or several surface parts carrying the particles, and, within a second process step, clean the substrate from collected particles using an deionization electrode, wherein the substrate comprises a micro fiber- and/or nano fiber flexible sheet material, and wherein the substrate displays electrically isolating and gas- and air permeable properties.

Hence, the present invention relates to a substrate adapted for particle collection and subsequent particle cleaning, comprising a piece of flexible sheet material adaptable for collecting loose and/or loosened particles, and a support layer arranged to support the piece of flexible material and fastened to one side of the piece of flexible material, wherein both the piece of flexible sheet material and the support layer are commonly adaptable to be gas- or air permeable for at least the cleansing and/or cleaning effect.

On the one hand, here is referred to an air stream, adapted for cleansing and/or cleaning of loose or loosened particles added to and collected on the substrate and its piece of flexible sheet material, and generated under an overpressure, and therefrom formed concentrated air jets, which are adapted to, under said overpressure for the cleansing, pass through the substrate in a direction through the support layer and the piece of flexible sheet material.

On the other hand, and for the same purpose, an air stream generated under an underpressure and therefrom formed concentric air jets, are to be adapted to, under this underpressure, pass through the substrate, in a direction through the support layer and the piece of flexible sheet material.

Here, the substrate will consist of the said piece of flexible sheet material and a support layer, fastened to the piece of flexible sheet material against a side facing a support layer and supporting the piece of flexible sheet material, wherein both are arranged with mutually adapted air permeable properties.

Furthermore, the invention encompasses an arrangement, adaptable for a collection of loose or loosened particles and for a cleaning of a surface or surface part supporting the said loose and/or loosened particles, here illustrated as belonging to a sheet or the like, and wherein the said loose and/or loosened particles at least can display so small grain sizes so that they for most part will fall within a micro field ($10^{-6}$ m) and/or even fall within a nano field ($10^{-9}$ m).

Thus, the present invention proposes a filter unit, displaying an extremely efficient particle collecting capacity and which hence is able to leave the surface adapted for cleaning "totally" particle-free.

These loose and/or loosened particles may, as a first example, be formed through a grinding or polishing processing of a planar or to another shape formed, processed surface part, whereby an air permeable substrate can be adapted to be movable in relation to the said surface part, and with an underpressure acting on one of the sides of the piece of flexible sheet material, so as to suck up and collect (and temporarily store) the said loose and/or loosened particles from the said processed surface part, belonging to the said sheet, as a first process through generated air streams and/or air jets, towards and through the piece of flexible sheet material so that the piece of flexible sheet material can collect and temporarily store these particles.

Within the scope of the invention also fall other actions for, as a second process, clean and cleanse the piece of flexible sheet material from therein collected and temporarily stored particles, by generating and exploiting air streams and/or air jets directed through the piece of flexible sheet material.

THE BACKGROUND OF THE INVENTION AND PRIOR ART

Methods, arrangements and constructions related to the above described technical field, and with a function and properties that meet set requirements, are previously known in a variety of embodiments, regarding the method itself, regarding the substrate itself and regarding the disclosed arrangement.

The Method

To the state of the prior art belongs a method to, using a substrate as a part of a first process step, collect and temporarily store loose and/or loosened particles from surface parts supporting the particles and, in a second process step, clean the substrate from particles collected therein.

To this end, it has been proposed to exploit a substrate comprising a flexible micro fiber- or nano fiber sheet material with known qualities.

Such a sheet material can be cleaned from collected particles by rinsing it in water.

A particle collection of this type takes place by a physical collection and storing within the sheet material.

The Substrate.

As an example of the state of the art and the technical field of the invention it can be mentioned, in relation to a substrate, various forms of particle collecting and particle rinsable flexible sheet materials, and where flexible sheet materials of this type certainly have turned out be able to, when moist with water and/or solvent, physically take up individual relatively coarse particles, but of course also to a large extent accompanying smaller particles.

Hence, it is known to, as with a wiping cloth, collect particles, with various grain sizes, from an upper surface part of a sheet or a floor, and where the wiping cloth as a rule is dry or at least only somewhat damp.

It is also known to prepare a plastic material to form these cloths, in the form of so called micro fiber cloths, so that these cloths can collect not only smaller particles but also larger particles, and thereby serve as a wiping cloth, and where a cleaning of a particle-containing wiping cloth of this type is to take part through rinsing in water or another fluid. The Arrangement.

As to the arrangement of the present type, it is worth mentioning that it is previously known to create various prerequisites for a polishing and/or cleaning of large surfaces or surface parts, related to various sheets.

The arrangement or the present type has then, as an example, turned out to be applicable within the wood processing industry, in which sheets and similar wood materials, during and after a polishing process, carefully must be cleaned from loose and/or loosened particles generated in the polishing process, before a treatment in a subsequent final processing step, here exemplified as a thin application of lacquer or paint.

More specifically, an arrangement is here known for cleaning of one or several surface parts supporting loose and/or loosened particles, and wherein the said loose particles at least can display a grain size which largely will fall within the micro field and/or partly will fall within the nano field, and which may be formed by the polishing or grinding processing of the said surface part and the said material.

Various arrangement related methods are also known for, within the arrangement, be able to create a removal of collected particles.

For this purpose, it is known to use a gas- or air permeable substrate, inter alia in the form of a piece of flexible sheet material, which may be movably adapted in relation to the said surface part and with an underpressure acting on one side of the piece of flexible sheet material, in order to suck up the said loose and loosened particles, by use of generated air streams, from the piece of flexible sheet material that may be arranged facing towards the said surface part, and be stuck and stored therein.

If the features of the present invention are considered, it can be mentioned that various shapes for and uses of known so called microfiber cloths are known, for cleaning purposes.

Such a microfiber cloth, which is adapted to the present invention, is to consist of closely oriented elongated threads, using a polyamide/polyester plastic material manufactured via an extrusion process, and cleaved to form very thin threads, so that they via a performed cleaving process form parallel oriented thin "straws" and where such cleaving has turned out to be advantageous in various ways.

More specifically, the present invention teaches that these used thin plastic straws should be shaped with a triangular 15 cross-section, with the individual thin threads cleaved to a thickness of 0.10 to 0.15 (denier).

If the features of the present invention are considered, it can be mentioned that various types of ionization electrodes and/or deionization electrodes are previously known for the forming of an electrostatic field for giving rise to a field strength.

Herein, ionization is a process which will transform neutral atoms or molecules into ions. A first ionization degree is related to the energy required to remove an electron from a neutral atom.

The invention will also use the presence of electrical fields, where the electrical field strength (Newton/Coulomb N/C) is used and where the energy density is proportional to the square of the field strength. The size of the absolute value is defined as the quotient between the absolute value of the force and the size of the charge.

When it now comes to the features of the present invention, as prior art can also be mentioned that, on page 3 in the Swedish patent publication 531 307, lines 30 and onwards, it is disclosed that, for certain powder formed and/or a powder grinded and formed lubricants for the lubricating application, these display both good electrostatic properties, specific charging properties and offer a specific capacity or capacitance.

Various methods to establish a value for the electrostatic properties of a substance, its charging properties and/or specific capacity or capacitance are also as such previously known.

Hence, it is previously known to allow a "decay time" and a capacitance for a material, and to this end it is referred to the publication "Journal of Electrostatics" 54 (3/4), March 2002, page 223, with the article "New Approaches for Electrostatic Testing of Materials".

Description of the Technical Problem of the Present Invention

If the circumstance is taken into consideration that the technical considerations which a skilled person within the present technical field must go through in order to be able to offer a solution to one or several of the posed technical problems, encompass both initially a necessary understanding of the measures and/or the sequence of measures that must be taken as well as a necessary selection of the means required, as a consequence, the following technical problems should be relevant when producing the present inventive subject-matter.

Considering a method according to the present invention, it should be considered a technical problem to realize the importance of, the advantages associated with and/or the technical measures and considerations required to, for a method according to the preamble of claim 1, indicate that to a piece of flexible sheet material apply, to its surface facing away from the particles, an electrically isolating, gas- and air permeable support layer for fixing a substrate.

There is a technical problem in the realization of the importance of, the advantages associated with and/or the technical measures and considerations required to provide the said substrate, with flexible sheet material and support layer tightly co-arranged, with an electrostatic field with a variable, such as decaying, electrostatic field strength in relation to the particles, for its particle cleaning function along a surface part, so that an attracting force, acting in relation to the particles and depending on the varying value of the field strength, will affect the said loose and/or loosened particles for a collection within the piece of flexible sheet material.

There is a technical problem in the realization of the importance of, the advantages associated with and/or the technical measures and considerations required to rinse the piece of flexible sheet material from collected particles by deionizing the substrate and the particles, and thereafter to apply penetrating air streams directed through the support layer, and, using air jets formed by the support layer and present within the piece of flexible sheet material, blow the piece of flexible sheet material free from collected and deionized particles.

There is a technical problem in the realization of the importance of, the advantages associated with and/or the technical measures and considerations required to allow the said collected and deionized particles, with a mixture of various grain sizes, to be removed from the piece of flexible sheet material by allowing concentrated air streams, with an underpressure, to act towards the particle collecting surface of the piece of flexible sheet material, with formed concentrated air jets, while air jets under an overpressure are allowed to act through the support layer and the piece of flexible sheet material.

There is a technical problem in the realization of the importance of, the advantages associated with and/or the technical measures and considerations required to allow the selected electrostatic field, with its variable, such as decaying, field strength, to act on the particles distributed along the surface parts depending on a small distance between the particle collecting surface of the flexible sheet material and the surface parts supporting the loose particles.

Considering the state of the art, as described above in relation to a substrate, it should therefore be considered a technical problem to realize the importance of, the advantages associated with and/or the technical measures and considerations required to, for a substrate, adapted for a particle collecting and a particle cleaning, and displaying a piece of flexible sheet material adapted for collecting loose and/or loosened particles, and a support layer cooperating with and supporting the piece of flexible sheet material, where both the piece of flexible sheet material and the support layer are gas- and air permeable for a cleaning of and a cleansing of collected loose and/or loosened particles within the piece of flexible sheet material, after the substrate and the particles have been deionized, while using generated air jets that, under an overpressure, are passed through the substrate, in a direction through the support layer and the piece of flexible sheet material and/or while using generated air jets that, under an underpressure, are passed through the substrate, in a direction through the support layer and the piece of flexible sheet material, and thereto to indicate that the said piece of flexible sheet material is to be adaptable for forming a filter unit serving to at least collect individual micro- and nano particles.

There is a technical problem in the realization of the importance of, the advantages associated with and/or the technical measures and considerations required to at least let the said support layer be adapted to display relatively large through holes, in order to via these distribute air passages through the piece of flexible sheet material as air jets, under an underpressure or an overpressure, and that the said piece of flexible sheet material is to display a micro- or nano fiber structure, and where this structure is to be subjected to an electrostatic state and slowly varying and decaying field strength, for collection of the said loose and/or loosened particles, and where this collection of particles at least is to take place while the whole substrate and the particles are present in an arranged electrostatically decaying field or field strength.

There is a technical problem in the realization of the importance of, the advantages associated with and/or the technical measures and considerations required to allow a total surface share of the openings of the support layer be adapted to cover the total surface part of the piece of flexible sheet material to at least 50%, and that both the piece of flexible sheet material and the support layer are to be formed from the same or separate, however electrically isolated, material, and that both the piece of flexible sheet material and the support layer for the cleaning effect of the surface parts are arranged under an electrostatic field and associated with a well adapted electrostatically decaying field strength, related to the said substrate, for affecting the individual particles distributed along the surface parts with variable attractive forces.

There is a technical problem in the realization of the importance of, the advantages associated with and/or the technical measures and considerations required to allow the said piece of flexible sheet material to be structured with a density which increases against the direction of an air passage as seen in a direction of motion because of the generated ionization of the particles, but an increasing density which is adapted for micro particles and/or nano particles, in a direction towards the area of the piece of flexible sheet material facing towards the support layer, denoted bottom area and/or bottom extension.

There is a technical problem in the realization of the importance of, the advantages associated with and/or the technical measures and considerations required to select the material of the flexible sheet material to be soft and primarily with a thickness of preferably 2 to 10 mm, such as 1 to 5 mm, and that the material of the support layer is to be selected to be relatively rigid, in relation to the rigidity of the flexible sheet material, and with a thickness of preferably 1 to 5 mm, such as 2 to 4 mm.

There is a technical problem in the realization of the importance of, the advantages associated with and/or the technical measures and considerations required to, at an arrangement adapted for using a substrate of the above described type, for a surface part adapted for cleaning loose and/or loosened particles, and where said loose and/or loosened particles at any rate can display a grain size which for most part will fall within the micro field and/or within the nano field, such as formed by a polishing processing of the said surface part, whereby an air permeable substrate, inter alia in the form of the said piece of flexible sheet material and a support layer fastened thereto, can be adapted to be movable in relation to the said surface, whereby a cleaning of particles collected within the piece of flexible sheet material can take place, in a deionized state, via an underpressure, acting along a first side of the piece of flexible sheet material, in order to, via generated air jets, suck up particles collected within the piece of flexible sheet material and/or where a cleaning of particles collected within the piece of flexible sheet material can take place using an overpressure, acting along the opposite side of the piece of flexible sheet material, in order to blow away particles collected within the piece of flexible sheet material using generated air jets, and where the piece of flexible sheet material and its supporting support layer both are associated with mutually different yet adapted air permeability properties, and thereby allowing the piece of flexible sheet material to be adapted to form a filter unit which is adapted to, at least under electrostatic prerequisites, collect micro- and nano particles, wherein said piece of flexible sheet material and support layer for the said substrate are adapted to display through openings, intended to distribute air passages through the piece of flexible sheet material of air streams and/or air jets, under an underpressure and/or an overpressure, and that the said piece of flexible sheet material displays a micro- or nano fiber structure for collecting and storing the said loose and/or loosened particles, under an ionized and decaying electrostatic state.

There is a technical problem in the realization of the importance of, the advantages associated with and/or the technical measures and considerations required to adapt a minimized distance under ionizing conditions, between particle collecting parts within the piece of flexible sheet material and cleansing surface parts, and under ionizing conditions of the particles and the piece of flexible sheet material to adapt this distance depending on the calculated particle amount which is to be collected and the selected relative velocity between the piece of flexible sheet material and the parts.

There is a technical problem in the realization of the importance of, the advantages associated with and/or the technical measures and considerations required to allow an arrangement to be adapted to support an endless substrate, which is adapted to, as a band, continuously run around distributed breaking rolls and where the substrate is soft and with a thickness of the piece of flexible sheet material of 2 to 10 mm and while the support layer is relatively rigid and with a thickness of 1 to 5 mm.

There is a technical problem in the realization of the importance of, the advantages associated with and/or the technical measures and considerations required to allow the arrangement for cleaning of a surface part supporting loose and/or loosened particles, where the said loose and/or loosened particles display a grain size which for most part will fall within the micro field and/or within the nano field, such as formed by a polishing processing of the said surface part, wherein an air permeable substrate, inter alia in the form of a piece of flexible sheet material and a support layer, is adapted to be movable in relation to the said surface, in an ionized state, whereby a cleaning of particles collected within the piece of flexible sheet material can take place within the arrangement, in a deionized state, via an underpressure acting on one of the sides of the flexible sheet material, to suck up particles collected within the piece of flexible sheet material using generated air streams and air jets, and/or where cleansing of particles collected in the piece of flexible sheet material can take place via an overpressure acting on the opposite side of the flexible sheet material, in order to blow away deionized particles collected within the piece of flexible sheet material, and where the piece of flexible sheet material and its supporting support layer are both arranged with gas- or air permeable properties.

There is a technical problem in the realization of the importance of, the advantages associated with and/or the technical measures and considerations required to allow the said endless substrate within the arrangement to be adapted to form a filter unit arranged to at least collect micro- and nano particles, where the said support layer and the said piece of flexible sheet material together are adapted to display differently structured through openings, where the cooperation between these openings is intended for a distributing air passage as air jets through the flexible sheet material, under an underpressure or an overpressure, and where the said piece of flexible sheet material displays a micro fiber- or nano fiber structure along its entire length and width.

There is a technical problem in the realization of the importance of, the advantages associated with and/or the technical measures and considerations required to, at an arrangement of the present type, allow the substrate to be formed as a motor-driven endless strip, with a direction of motion adapted to be with or against the direction of motion of the sheet arranged for the surface parts to be cleaned from particles, and to subject the said surface part and/or its particles to a deionizing function before the surface parts are subjected to an ionizing cleaning from particles.

There is a technical problem in the realization of the importance of, the advantages associated with and/or the technical measures and considerations required to, within the arrangement, allow a charging- or ionizing electrode acting on the substrate, to be located immediately before the surface parts adapted for particle collection.

There is a technical problem in the realization of the importance of, the advantages associated with and/or the technical measures and considerations required to, at the arrangement, allow one or several of the breaking rolls adapted for the driving of the endless substrate, to be shaped and/or controllably affected to center the direction of motion of the substrate through the arrangement.

There is a technical problem in the realization of the importance of, the advantages associated with and/or the technical measures and considerations required to allow a discharging electrode, acting on the particles and the electrode, to be oriented adjacent to the surface parts cleaned from loose particles and located against the direction of motion of the surface part of the material after the arrangement.

There is a technical problem in the realization of the importance of, the advantages associated with and/or the technical measures and considerations required to allow a discharging electrode, for discharging of a particle collecting substrate, in the form of an endless strip and arranged to be chargeable under a field strength which is electrostatically variable, such as decaying, to be located in the direction of transport for the strip, after the particle-collecting surface parts and its direction of transport.

There is a technical problem in the realization of the importance of, the advantages associated with and/or the technical measures and considerations required to orient a particle- or vacuum sucking ramp, with an upstream arranged integrated discharging- or deionization electrode, adjacent to the said discharging electrode.

The Solution

The present invention relates to a method for, using a substrate, in a first processing step, collecting loose and/or loosened particles from surface parts supporting the particles, via an ionizing state and an activated electrostatic field strength, in a deionized state and a neutral electrostatically changing, such as decaying, field strength, using a piece of flexible sheet material comprising the substrate and being impenetrable for micro fibers and/or nano fibers, and where both the piece of flexible sheet material and its support layer display electrically isolating and gas- and air permeable properties.

At such a method it is proposed, according to the invention, to apply an electrically isolating and gas- and air permeable support layer to the surface parts, of the said substrate and its associated piece of flexible sheet material, facing away from its loose and loosened particles.

Furthermore, it is proposed that the said substrate, with its flexible sheet material and its support layer, for its particle collection is arranged with a decaying electrostatic field with a field strength acting in relation to the loose or loosened particles, in order to, using a variable attracting force, adapted to the variable electrostatic field strength and acting on the said loose and loosened particles, collect the said attracted loose and loosened particles within the flexible sheet material.

It is especially proposed that the thus, by attracting forces in a deionized state, collected particles, are removed using a number of air jets formed by an underpressure and/or an overpressure.

In particular, an endless substrate is proposed which, in the transport direction, immediately before a collection of loose and loosened deionized particles, is to be ionized and associated with an electrostatically decaying field strength, while the substrate, immediately after a collection and a storing of the loose and/or loosened particles within the flexible sheet material, deionizing the flexible sheet material, the support layer and the particles, and thereafter cleansing the flexible sheet material from thus collected and neutralized particles.

Moreover, it is proposed according to the invention that the modified, such as decaying, field strength for the electrostatic field can be selected, such as for planar particle supporting surface parts and a planar, or to any extent essentially planar, and parallel oriented substrate, to be decreasing towards the deionization electrode.

Thereby, the present invention starts off in the initially described known art in which a substrate arranged for particle cleaning of a surface part, and comprising a piece of flexible sheet material adapted for the collection of loose and/or loosened particles, and a support layer cooperating with and supporting said piece of flexible sheet material, where both the piece of flexible sheet material and the support layer are air permeable for a cleansing of collected loose particles and/or loosened particles, using one or several generated air streams, divided into a number of concentrated jets, that, under an overpressure, are allowed to pass through the substrate, in a deionizing state, in a direction through the support layer and the flexible sheet material and/or are allowed to pass through the substrate using one or several generated air streams, under an underpressure and in a direction through the support layer and through the flexible sheet material.

According to the present invention and with the purpose of building upon the prior art, it is proposed that the said substrate and a piece of flexible sheet material comprised therein are adapted to form a filter unit which is adapted at least for the collection of micro- and/or nano particles, where the said support layer for the said flexible sheet material is adapted to display through openings that direct air passages in the form of air jets through the flexible sheet material, under an underpressure or an overpressure, and that the said flexible sheet material displays a micro- or nano fiber structure for a collection of the said loose and/or loosened particles, and to allow this collection of particles to take place in an ionizing state for at least the substrate.

More particularly, the present invention adds to the prior art with the purpose of solving one or several of the above described technical problems, in that the total surface part of the openings of the support layer covers the total surface of the flexible sheet material to at least 50%, whereby both the piece of flexible sheet material and the support layer are formed from a similar or alternative electrically isolating material, and in that both the piece of flexible sheet material as well as the support layer for its cleaning effect on the surface parts are ionized and associated with a decaying electrostatic field strength, while the cleansing of collected particles within the flexible sheet material can take place in a deionized state.

Furthermore, it is proposed that the piece of flexible sheet material is structured with an increasing density in a direction against the direction of an air passage and as seen towards the support layer, with an increased density adapted for micro particles and/or nano particles adjacent to and within the bottom arena and bottom extension of the support layer of the piece of flexible sheet material.

Further, it is proposed that the piece of flexible sheet material is soft and has a thickness of 2 to 10 mm, while the support layer is stiff and with a thickness of 1 to 5 mm.

As preferred embodiments falling within the scope of the basic idea of the present invention, it is further proposed an arrangement for cleaning of a surface part supporting loose and/or loosened particles, and where said loose and/or loosened particles at least can display a grain size which for most part falls within the micro field and/or the nano field, such as formed by a polishing processing of the said surface part, whereby a gas- or air permeable substrate, inter alia in the form of a piece of flexible sheet material and a support layer, according to the above, can be adapted to be movable in relation to the said surface part, whereby a collection within the piece of flexible sheet material of particles using an electrostatically decreasing or increasing field strength, can take place after an ionization acting on a first side of the piece of flexible sheet material, in order to, using generated air streams and a selected ionization, suck up and within the piece of flexible sheet material store particles and/or a cleansing of particles collected within the piece of flexible sheet material can take place via a deionization and an overpressure acting on the opposite side of the piece of flexible sheet material, in order to, using generated air streams and air jets, blow away particles collected within the piece of flexible sheet material, and where the piece of flexible sheet material and its supporting support layer are both associated with different air permeability properties.

According to the invention, the said piece of flexible sheet material within the arrangement is adapted to form a filter unit arranged for at least collection of micro- and nanoparticles, where the said support layer for the said piece of flexible sheet material is adapted to display through openings for a distribution of available air passages through the flexible sheet material of air streams and air jets, under an underpressure or an overpressure, and that the said piece of flexible sheet material displays a micro- or nano fiber structure, for a very efficient collection of the said loose and/or loosened particles, in an ionizing and decaying electrostatic state.

More specifically, the total surface share of the openings of the support layer is adapted to at least to 50% cover the total surface of the piece of flexible sheet material, and that both the piece of flexible sheet material as well as the support layer, for their cleaning effect of particles along the surface parts, are ionized and associated with a well varying electrostatic field.

Then, the said piece of flexible sheet material can be structured with an increased density as viewed towards the direction of an air passage, with an increased density adapted for micro- and nano particles within the area of the piece of flexible sheet material facing the support layer, denoted bottom area and bottom extension.

The arrangement and its substrate are here formed as an endless strip, driven by a motor, with a continuous direction of motion direction along or against a direction of motion for a sheet associated with the surface parts, and the said surface parts are subjected to a deionizing process before a cleaning takes place of collected loose particles.

Furthermore, it is proposed that a charging electrode acting on the substrate is to be positioned, in the direction of transport of the substrate, before the surface parts adapted for particle collection.

One or several breaking rolls adapted for the driving of the substrate within the arrangement are to be shaped or otherwise affected to center the direction of motion of the endless substrate.

More specifically, it is proposed that a discharging electrode is oriented adjacent to the surface parts cleaned from particles, and located in the direction of motion of the material after the arrangement.

Further, it is proposed that a discharging electrode for a particle collecting substrate, in the form of an endless strip, is located, in the direction of transport of the strip, after the particle collecting surface parts associated with the arrangement.

Adjacent to the electrode, there is a ramp adapted for vacuum cleaning and/or particle collection, with an integrated discharging electrode.

Advantages

The advantages that most importantly characterize the present invention, its method, substrate and/or arrangement, and the thereby specified characterizing features, are that it hereby has been created prerequisites to, at a method, a substrate arranged to collect and contain particles, and an arrangement, device, for a particle collection, display a piece of flexible sheet material adapted for the collection of loose and/or loosened particles, and a support layer cooperating with and supporting the flexible sheet material, both associated with an electrostatic field with a selected, preferably modifiable field strength.

Both the piece of flexible sheet material and the support layer should be adapted to be gas- or air permeable for a cleansing of loose particles and/or loosened particles collected within the piece of flexible sheet material, using a generated air stream or generated air jets, that in a deionized state and using an overpressure are allowed to pass through the substrate, in a direction through the support layer and the piece of flexible sheet material and/or using one or several generated air streams, under an underpressure, that are allowed to pass the substrate, in a direction firstly through the support layer and immediately thereafter through the flexible sheet material.

What should be considered most characterizing for the present invention, directed towards a method, is stated in the characterizing portion of subsequent claim 1, a substrate is described in the characterizing portion of claim 6, while an arrangement according to the present invention is described in the characterizing portion of claim 10.

SHORT DESCRIPTION OF THE DRAWINGS

A previously known production plant with its shown three processing steps and a substrate, in the form of a presently proposed embodiment, displaying the characteristics associated with the present invention, and an arrangement, within which the proposed substrate may be used, will now be disclosed in closer detail with an exemplifying purpose, and described in relation to the appended drawings, in which:

FIG. 1 shows a side view of the known production plant with its three serially oriented processing steps.

FIG. 2 shows a schematic side view of a particle collecting and particle cleansing arrangement, where the particle collection depends upon an ionization of an electrically isolating endless substrate, arranged to pass immediately above a surface part arranged with loose particles, to concentrate, within a piece of flexible sheet material containing the substrate, loose and/or loosened individual particles under an electrostatically varying field strength.

FIG. 3 illustrates, in a section along the substrate, the said piece of flexible sheet material and a support layer fixedly cooperating with the piece of flexible sheet material, where the piece of flexible sheet material is oriented immediately above the surface parts arranged with the loose particles.

FIG. 4 schematically shows an electric coupling arrangement adapted to be a control equipment, arranged to, taking into consideration a number of selected control- or supervisory criteria, among other things control and supervise the individual ionization magnitudes of one or several charging electrodes and the efficiency of one or several discharging electrodes, among other things controlled to a minimized electric power for a maximized technical particle collecting effect.

Figure 8:
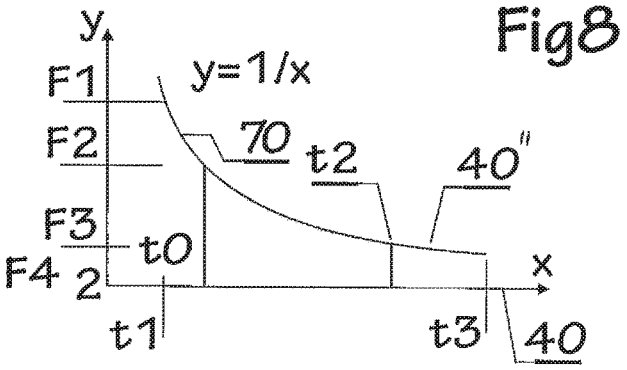
Figure 7:
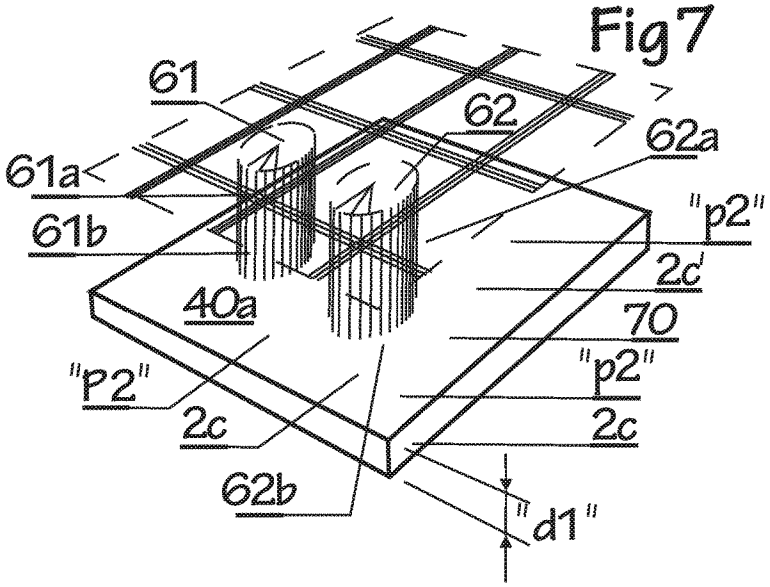

FIG. 7 illustrates, in a heavily enlarged and simplified manner, two threads built up as a micro- or nano structure, that has been treated to form micro structure- or nano structure displaying bundles of thin "straws", but where the shown illustration can be seen as very schematic and where the free ends of the shown micro or macro straws are oriented in immediate adjacency to and with a slightly dragging contact to the surface parts and across the surface parts arranged with loose particles, and FIG. 8 schematically shows an example of the time related progress of a decaying curve concerning electrostatic field strength.

DESCRIPTION OF THE PREVIOUSLY KNOWN PRODUCTION PLANT ACCORDING TO FIG. 1

In the following description of prior art and the present invention, it seems appropriate to distinguish between different processed surfaces with mutually different coatings of dust and powder particles, where the following reference numbers have been selected as regards the change of the surfaces and the particle concentrations through the processing steps of the production plant.

The reference number 2 illustrates a sheet which is movable through the plant, the upper surface 2*a* of which sheet is to be considered a raw surface and where this raw surface will go through various processing and treating modifications, which then are indicated with surface parts 2*b*, 2*c* and 2*c'*.

Thus, the raw surface 2*a* is untreated, and which surface 2*a* is processed in a grinding or polishing machine 3 in order to form a polished outer- or upper surface 2*b*, where this outer surface 2*b* displays a concentration of loose and/or loosened particles "P" (coarse grain size), with a broad spread of large and smaller particles after the described polishing using an abrasive paper 3*a*.

The surface 2*a* can be assumed to be free from free or conglomerated particles, the surface 2*b* can be said to be provided with loose and coarse particles "P" in a mixture of large, coarse and smaller particles, the surface 2*c* can be said to, after a vacuum cleaning via a vacuum cleaner 4, be free from at least the coarser particles and be denoted "P1".

This outer- or upper surface 2*b* will now be vacuum cleaned via a vacuum cleaner 4, which thereby gives rise to an additionally particle freed "P1" surface 2*c*.

After an additional vacuum cleaner 4', a surface 2*c'* arises, with an additionally vacuum cleaned surface part 2*c'* with a set of particles denoted "P2".

This surface 2*c'* is further processed in a spray plant 5 for applying an upper-most layer 2*d*, and where such layer 2*d* will cover any remaining particles "P2", and therefore form a small elevation 2*d'*; ("P2").

As the particles "P2" follow, and are positioned below the layer 2*d* which the plant 5 applies, these particles "P2" will, when applying the layer 2*d* thinly, appear as small elevations 2*d*' or cavities, worsening the aesthetic appearance of a planar and blank upper surface 2*d*.

The reference number 2*a* illustrates a surface which has yet to be leveled and processed by polishing 3, the reference number 2*b* illustrates a surface with coarse particles "P" accruing from the polishing in a particle concentration, a surface 2*c* illustrates a vacuum cleaning performed by a vacuum cleaner 4, with the particles "P1", the reference number 2*c*' illustrates the surface adapted for a finishing treatment with the particles "P2", which has been additionally vacuum cleaned via a vacuum cleaner 4', which within the spray plant 5 is coated with an additional layer 2*d*, where this layer also encloses the particles "P2" remaining within the previous process.

The process steps 1*a*, 1*b* and 1*c* with associated pieces of equipment, are known as such, and are therefore not described in detail.

However, the prior art does not disclose that the particle free surface 2*c*' in many applications is not so free from particles as would be desirable, why the layer 2*d* will cover and embed remaining particles "P2", either with a thin uneven (granular) surface 2*d*' with its embedded particles ("P2") or with an unnecessarily thick layer 2*d*.

Description of the Presently Proposed Embodiment

Initially, it is noted that in the following description, of a presently proposed embodiment displaying the characterizing features associated with the invention and made clear by the figures shown in the enclosed drawings, we have selected expressions and a specific terminology with the intent of primarily clarifying the basic idea of the invention.

However, in this context it should be taken into consideration that herein selected expressions are not to be seen as limited only to the herein exploited and selected terminology, but it is to be understood that each such selected expression is to be interpreted so that it additionally encompasses all technical equivalents working in the same or essentially the same way, in order to thereby achieve the same or essentially the same purpose and/or technical effect.

Primarily, the present invention relates to a method, which initially shall be described according to the following.

The method is adapted for, using a substrate 40, within a first processing step "S1" (see FIGS. 2 and 3), collect loose and/or loosened particles from surface parts 40*a* supporting the particles, via an ionizing state and an activated electrostatically varying and time-decaying field strength 70, within FIG. 8, and within a second processing step "S2" cleanse the substrate from collected particles "p2", in a deionized state and a neutral electrostatic field strength, using a piece of flexible sheet material 41 which is impenetrable for micro fibers and/or nano fibers, and where the flexible sheet material 41 as well as its support layer 42 display electrically isolating and gas- and air permeable properties.

At such a method it is proposed to, according to the teachings of the present invention, to the side of said substrate and its associated piece of flexible sheet material 41 facing away from its loose and/or loosened particles "p2", apply an electrically isolating support layer 42, displaying gas- and air permeable criteria.

Furthermore, it is proposed that the said substrate 40, with its flexible sheet material 41 and its support layer 42, for its particle collection, is associated with an electrostatic field, with a time-varying field strength 70 in relation to the loose or loosened particles "P2"; "p2", so that a varying attractive force, adapted by the electrical field strength, can act on the said loose and loosened particles "p2" and with the field strength collect the said loose and loosened particles within the flexible sheet material 41.

In particular, it is proposed that the thus, by attracting forces, collected particles "p2" shall, in a deionized state, be removed using a number of air jets formed using an underpressure and/or an overpressure.

In particular, an endless substrate 40 is proposed, which, as seen in its direction of transport, immediately before a collection of loose and loosened, deionized particles, "P2", "p2", is to be ionized and associated with an electrostatic field strength 70, while the substrate 40, immediately after a collection and a storing of the loose and loosened particles "p2" within the flexible sheet material 41, deionizes the piece of flexible sheet material 41, the support layer 42 and the particles "P2", "p2", and thereafter the piece of flexible sheet material 41 is cleansed from such collected and neutralized particles.

In addition, according to the teachings of the present invention, it is proposed that the varying field strength 70 for the electrostatic field can be selected for a planar particle-supporting surface part 40*a* and a planar, or to any extent essentially planar, and parallel oriented substrate 40 only by allowing the field strength to vary, according to FIG. 8, along a selected decaying curve.

Figure 2:
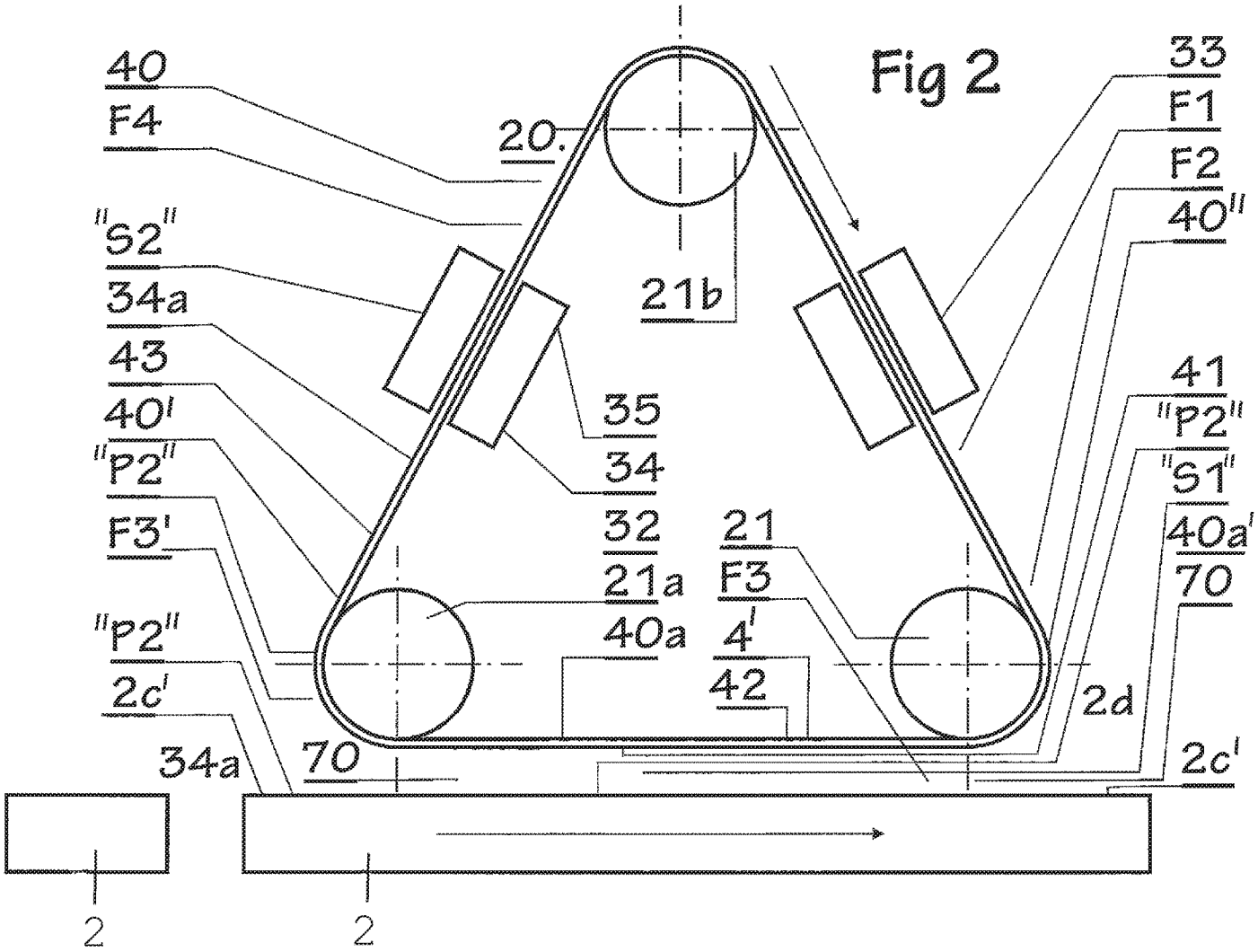

Nothing prevents that the surface part 40*a* of the substrate is arranged with a shape which is tapered across the surfaces 2*c*, 2*c*' to the right or to the left in FIG. 2, instead of a parallel oriented substrate 40, where a selected smallest distance "d1" offers a larger attracting force.

With reference to the enclosed FIGS. 2 to 7, the present invention is hence not only shown schematically and in detail, but the characterizing properties of the invention have also been given a concrete form, by the presently proposed and in the following in detail described embodiment.

Figure 1:
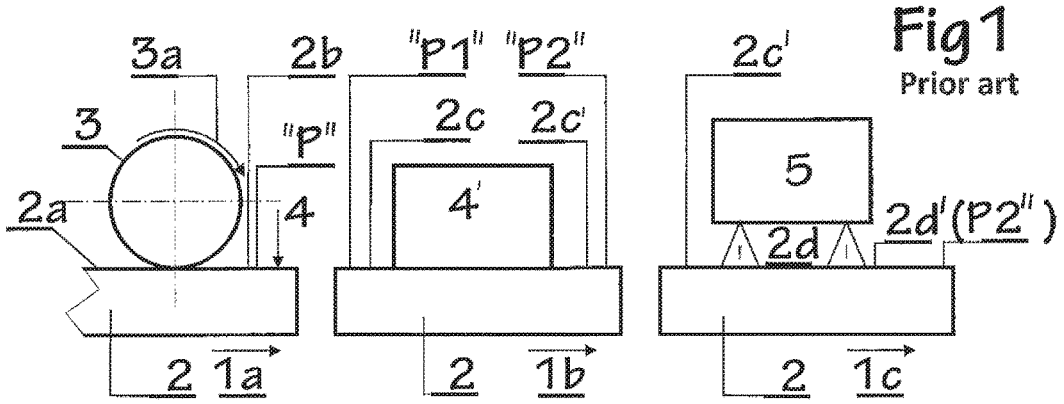
Fig1 Prior art

With renewed reference to FIG. 2, a particle collecting apparatus or arrangement 20 (corresponding to the vacuum cleaner 4' according to FIG. 1) according to the teachings of the invention is shown in a side view, using an outer surface part 40*a* belonging to the substrate and adapted for particle collection and particle concentration, and a surface part 40' which is likewise adapted for particle cleaning and belonging to the substrate, and the construction and function of which apparatus will be described in the following.

Figure 3:
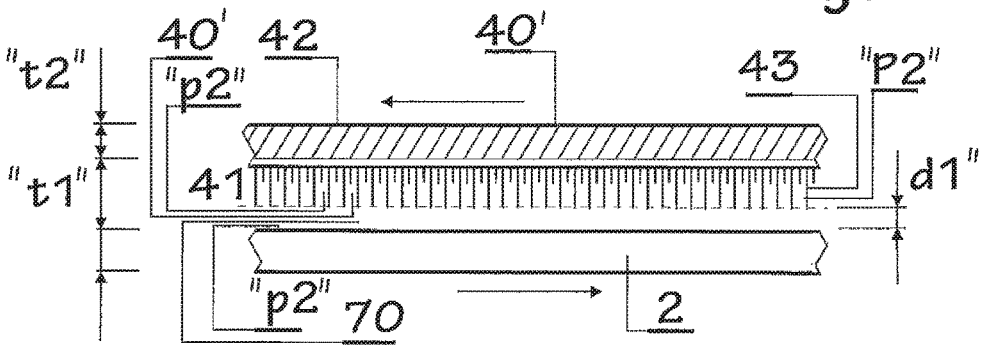

A substrate, adapted for particle cleaning, with its surface parts 40', as shown in FIGS. 2 and 3 and displaying a piece of flexible sheet material 41 is adapted for collection of loose and/or loosened particles "p2" (particles falling within the micro- and nano fields) and a support layer 42 tightly cooperating with and supporting the flexible sheet material.

Both the piece of flexible sheet material 41 and the support layer 42 are to be adapted so as to be air permeable, with the only purpose of being able to perform the cleansing process which will be required in order to be able to cleanse off collected loose particles "p2" and/or loosened particles "P2", using a generated air stream, divided into diverging air jets.

Figure 5:
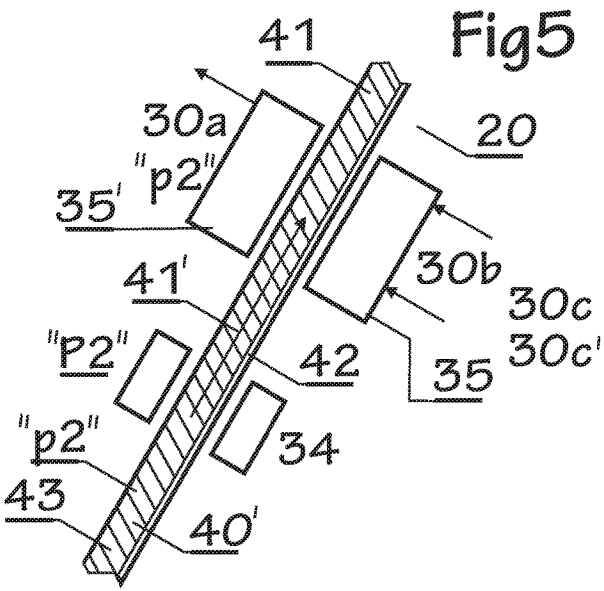
FIG. 5 shows an arrangement with an ionization electrode, oriented in a selected direction of transport for the substrate, before a unit arranged to cleanse the substrate and the piece of flexible sheet material from collected particles.

It is proposed that these jets are allowed to pass, under an overpressure, through the surface part 40' of the substrate, in a direction through the support layer 42 and the piece of flexible material 41, according to FIG. 5, and/or using a generated air stream, under an underpressure, are allowed to pass through the surface part 40', in a direction through the support layer 42 and the flexible sheet material 41.

Then, the present invention teaches that for the surface part 40' of the substrate, the said piece of flexible sheet material 41 is to be adapted for, within a short strip subsection, form a filter unit 43 arranged at least for the collection of micro- and nano particles, in order to, within the first processing step "S1" concentrate and store collected remaining coarse particles "P2" and loose small particles "p2" and within a second processing step "S2" cleanse the flexible sheet material 41 from these particles "P2" and "p2".

As for the second processing step "S2", the said support layer 42, which supports the said piece of flexible sheet material 41, is to be adapted to display narrow through openings 42*b* (see FIG. 6) for a distribution of an air passage 30*a*, under an underpressure and/or an air passage 30*b*, under an overpressure, directed through the piece of flexible sheet material 41 primarily by air streams distributed by the support layer 42, as more or less concentrated air jets.

The said piece of flexible sheet material 41 is to be considered, in relation to the support layers 42, as very dense, by the said piece of flexible sheet material 41 displaying a pronounced form of a micro- or nano fiber structure, arranged for collection and storing of said loose and/or loosened particles "P2"; "p2".

According to the teachings of the present invention, this collection may be performed as a consequence of the forces acting on the particles "P2"; "p2" in an ionized state and an electrostatic field or a varying field strength 70.

For this force affection, the particles "p2" may be ionized with a first polarity or potential (+) or may be neutral, while the piece of flexible sheet material 41 and the support layer 42 may be ionized with a second, opposite polarity or potential (−).

This collection of particles "p2" within the surface part 40' of the substrate and the piece of flexible sheet material 41 can take place by the forming of a directed electrostatic field, where the second polarity (−) may be imparted to the piece of flexible sheet material while the surfaces 2*c*, 2*c*' with their particles are neutralized, alternatively that the piece of flexible sheet material 41 and the surfaces 2*c*, 2*c*' are provided with a counter-directed electrostatic potential (+).

The herein implied electrostatic fields and their different field strengths 70 are intended to affect the particles "p2" with a force which results in that they are displaced from the surfaces 2*c*, 2*c*' and in a direction towards the piece of flexible sheet material 41, and is stuck there in the micro- or nano threads of the flexible sheet material and are stuck primarily in its extremely narrow and thin straws 61*a*, 62*a* in FIG. 7.

The substrate 40 shown in FIG. 3, in a longitudinal section, shall then display a piece of flexible sheet material 41 adapted for collection of loose particles "P2", "p2", and a support layer 42 for supporting the flexible sheet material, where both shall display electrically isolating properties, in order to be able to maintain and store the electric field while forming a decaying field strength 70.

According to the invention, both the piece of flexible sheet material 41 and the support layer 42 are to be adapted to be air permeable, with a primary intent of cleansing the substrate 40 the collected dust particles "P2", "p2" using formed air streams.

The herein implied air permeability can be used if, except for the implied ionization along the surfaces 2*c* and 2*c*', a vacuum cleaning adapted for the particle collection is to be used.

A cleansing of the substrate 40 from concentrated dust and loose particles "P2", "p2", within the particle collecting arrangement or apparatus 20, may take place using one or several air streams. This cleansing process may take place only while the air jets 30*b* are activated using an overpressure 30*c*, and this air stream is in that case directed so that it can pass through the substrate 40 in a direction firstly through the support layer 42 and thereafter through the piece of flexible sheet material 41, according to FIG. 5.

As a proposed alternative, the herein implied air streams, in the form of air jets 30*a*, may be formed by an underpressure, and these air jets may also pass the substrate 40 in a direction through the support layer 42 and the piece of flexible sheet material 41. A generated overpressure and its air jets 30*b*, as well as a generated underpressure and its jets 30*a*, may cooperate, or they may alternatively be used individually.

Nothing prevents to allow these air streams and air jets to be activated in a pulsating manner through a pulse generating unit 30*c*', which is merely implied in FIG. 5.

Nothing prevents that, for this cleansing process, air streams and air jets 30*b* are formed using an overpressure 30*c*, where these may be active on different parts of the substrate 40, and on different surface parts and from air streams and air jets 30*a*, from an underpressure, where these may be active on the different parts of the substrate 40 and on different surface parts.

It is specifically taught that these air streams primarily are to pass through the piece of flexible sheet material 41 as more or less linear streams, directed through the support layer 42 and its holes or openings 42*b*, and as more pronounced turbulent streams through the flexible sheet material 41, in to order to break loose and loosen concentrated particles "P2", "p2".

According to the present invention, the said piece of flexible sheet material 41 is to be dimensioned and adapted for forming a filter unit 42*b*, arranged for micro- and nano particles 2*b*' and a capacity which is well adapted to the application.

For this purpose, it will be required that the said support layer 42 is adapted to display densely oriented and small through openings 44, for via these densely oriented openings 42*b* distribute an air stream in the form of air jets through well distributed air passages, formed as channels and in the form of the implied openings 42*b*.

Practical experience indicates that the total surface part of the openings 42*b* is to be adapted to cover the total surface of the piece of flexible sheet material 41 to at least 50% or somewhat less.

If the present embodiment of the invention is considered, both the piece of flexible sheet material 41 and the support layer 42 are to be formed from an electrically isolating material, which is required in order for both the flexible sheet material 41 and the support layer 42, for their cleaning effect according to the invention, to be associated with a varying and decaying electrostatic field 70 via one or several associated ionization electrodes 33.

According to the principles of the invention, the piece of flexible sheet material 41 may be structured with an increased density, in a direction against the direction of air passage through the flexible sheet material 41, with a structure and density adapted for micro particles and/or nano particles within the area of the flexible sheet material facing towards the support layer 42 and/or a bottom area thereof and its extension.

In particular, it is herein proposed that a piece of flexible sheet material 41 of the present type can be associated with a thickness "t1", in FIG. 3, of about 2 to 10 mm, perhaps about 5 mm, while the support layer 42 may be associated with a thickness "t2" of about 3 to 5 mm, perhaps about 2.0 mm.

The thickness of the flexible sheet material 41 and its construction are to be adaptable to the loose particles storing capacity of the piece of flexible sheet material, the time during which the storing is to take place and/or depending on the velocity of the substrate 40.

Again referring to FIG. 2, an electrostatic particle collecting apparatus or arrangement 20 according to the invention will be described in closer detail.

Here is shown and described, in a simplified side view, an arrangement 20 for cleaning of a surface part 2*c*, 2*c*' supporting loose particles "P2", "p2".

This arrangement 20, for cleaning of the surface parts 2*c*, 2*c*', supporting loose and/or loosened particles "P2", "p2", where the said loose and/or loosened particles to any extent can display a grain size which for most part will fall within the micro field and/or the nano field, such as formed by a polishing processing of a surface 2*a*.

An air permeable substrate 40, inter alia in the form of a piece of flexible sheet material 41 and a support layer 42, is adapted to be continuously movable in relation to the said surface parts 2*c*, 2*c*', whereby a cleansing of particles "P2", "p2", collected within the piece of flexible sheet material 41, can take place using an underpressure, acting on a first side of the piece of flexible sheet material, in order to, via generated air streams, suck up and within the piece of flexible sheet material collect the loose particles.

A cleansing of particles collected within the piece of flexible sheet material 41 can take place via an overpressure acting on the opposite side of the piece of flexible sheet material, in order to, via generated air streams and air jets, blow away particles concentrated within the piece of flexible sheet material, and wherein the flexible sheet material 41 and its supporting support layer 42 are both associated with adapted air permeable properties with different structures.

When it comes to the arrangement 20, it is illustrated that the substrate 40 is to be formed as an endless strip, driven by a motor 32 and with a selected direction of motion along or against a direction of motion for a sheet 2 associated with the surface parts 2*c*, 2*c*', and that said surface is the subject of a polishing treatment and a deionization of these treated surface parts 2*c*, 2*c*' before a cleaning from particles can take place.

For the arrangement 20, it is proposed that a charging or ionization electrode 33 acting on the substrate 40 is to be located before the particle collecting surface part 40*a*, when this surface part by the driving will pass over and along the surface parts 2*c*, 2*c*' intended for the particle collection, and each surface part there between.

A breaking roll 21, arranged for driving the substrate 40, and/or other breaking rolls 21*a*, 21*b*, are shaped or affected to center the direction of motion of the substrate 40.

A discharging- or deionization electrode 34 is oriented adjacent to the surface part 2*c* which has been cleaned from particles, and located in the direction of motion of the substrate 40", in relation to and after the surface part 2*c*.

Adjacent to the electrode 34 there is a particle collecting ramp 35, with an integratedly formed deionization electrode 34, according to FIG. 5.

According to the teachings of the invention, the substrate should be shaped as an endless strip 40, 40", 40*a*, 40', driven by a motor 32 (not shown), with a direction of motion which is counter-directed in relation to a direction of motion for the sheet 2 associated with surfaces 2*c*, 2*c*', and where the said surfaces 2*c*, 2*c*', with their particles, can be subjected to a deionization function 34*a*, before the electrostatic cleaning takes place from remaining small particles "p2".

A breaking roll 21, adapted for driving the substrate 40 and driving the strip 40, 40', cooperates with the support layer with a straight surface part 40*a*, arranged to collect particles under an electric field strength 70, shaped with a horizontal extension between a breaking roll 21 and a breaking roll 21*a*, and where a particle-free strip 40 is linked over via an upper breaking roll 21*b*, where the latter primarily is to be shaped or influensable for centering the different parts of the strip 40 with collected particles "p2", so that the strip is linked over via a breaking roll 21*a* and a breaking roll 21*b*, where the latter primarily is to be shaped or influensable for centering the direction of motion of the strip 40, 40", 40*a*, 40'.

A deionization electrode 34*b* for a discharging of the sheet 2 is located, against the direction of transport for the strip 40, after the particle collecting surface parts 2*c*, 2*c*' have passed the arrangement 20.

Figure 4:
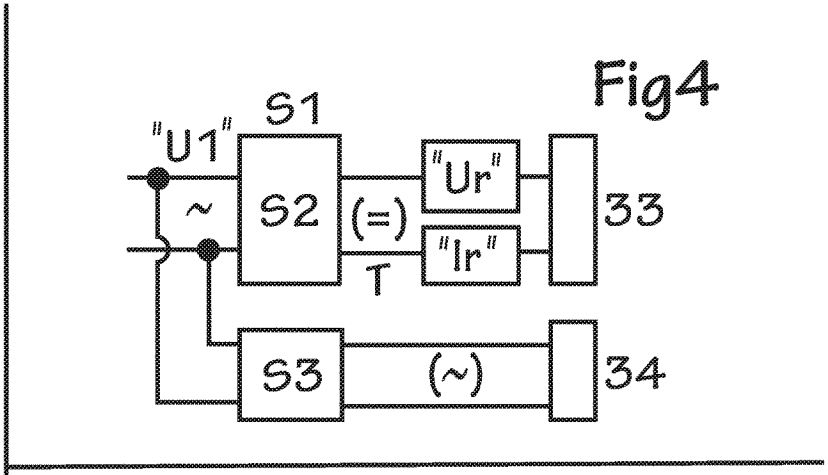

FIG. 4 schematically shows a coupling arrangement adapted to constitute a piece of electric, such as a control- or supervisory, equipment S1, arranged to control and supervise the individual ionization degrees of one or several charging- or ionizing electrodes 33 and the efficiency of one or several discharging- or deionization electrodes 34, while considering a number of selected control criteria, which electrodes are controllable for creating a maximized technical particle collecting effect with a minimum electric power.

Here it is shown that a feeding voltage "U1" is to be trans-formed, via a transforming circuit S2, to a voltage controlling circuit "Ur", and to a current controlling circuit "Ir".

Via an alternating current transforming circuit S3, the deionization effect of the deionization electrodes 34 is controllable.

It is here to be noted that the criteria which may come into use for this control within the control equipment S1 are according to the following:

- Sense or calculate the instantaneous magnitude of the instantaneous ionization and/or the electrostatic field strength.
- For this purpose, sense and/or calculate instantaneous current- and direct-current voltage values.
- Sense and control measured direct-current power, for each of the used ionization electrodes (33).
- Consider selected transport velocity for the substrate (40).
- Control selected parameters depending on prevailing and selected temperatures.
- Consider and control current atmospheric humidity.
- Consider the criteria which depend upon the constructions and/or the density of the piece of flexible microfiber- or nanofibre sheet material.
- Consider the criteria that depend upon the electrically isolating properties of the substrate and/or the piece of flexible sheet material, inter alia the decay time of the field strength, the relative capacitance of the substrate.

FIG. 5 shows and describes a part of an arrangement 20, namely the part to receive a particle collected and stored substrate 40' with its piece of flexible sheet material 41 and with a discharging- or deionization electrode 34, oriented in a selected direction of transport for the substrate 40 and its strip 40', before a unit 35 arranged to cleanse the substrate and the piece of flexible sheet material from concentrated particles "P2", "p2", which unit is here structured as a particle cleansing and particle collecting unit or a ramp 35'.

Figure 6:
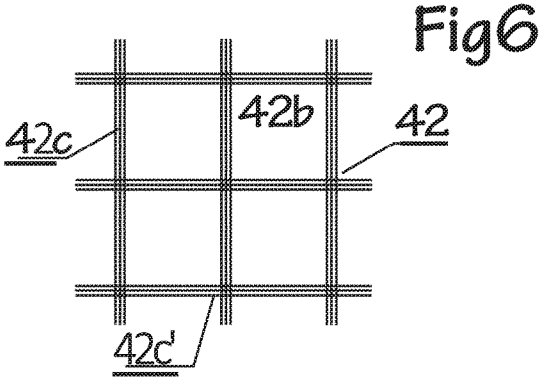
FIG. 6 shows, in a heavily enlarged plan view, a support layer, in the form of a right-angled grid structure, illustrating its quadratic openings and threads surrounding the openings.

FIG. 6 shows, in a heavily enlarged plan view, a support layer 42, in the form of a right-angled grid structure, illustrating its quadratic openings 42*b* and the threads 42*c*, 42*c*' surrounding the openings.

The selection of the size of the openings 42*b* and the shape and dimension of the threads 42*c*, 42*c*' will create the initially described relation.

FIG. 7 illustrates, in heavy enlargement and simplified, two threads 61, 62 built up as micro- or nano structures, that have been treated in a known way to form micro structure or nano structure bundles of straws 61*a*, 62*a*, but where the shown illustration can be considered to be strongly schematic and where the free end parts 61*b*, 62*b* of the shown micro- or nano straws are oriented in immediate adjacency to and somewhat dragging along and above, however not in contact with, the surface parts 2*c*, 40*a*', 2*c*' on which the loose particles "P2", "p2" exist.

The distance "d1" between the surfaces 61*b* and 62*b* and the surface part 2*c* should be dimensioned to be between 2 and 10 mm, and should normally not be in direct contact with the surface 2*c*, but it is within the scope of the invention for this distance to be as small as practically possible, as a smaller distance "d1" generates stronger attractive forces from the applied electrostatic field strength 70 than what is achieved with a larger distance.

Since the piece of flexible sheet material 41 and the support layer 42 are air permeable, it is within the scope of the invention to, using a vacuum cleaner 4' supplement the particle collection from the surface parts 2*c*, 2*c*'.

Decreasing, Such as Decaying, Electrostatic Field in FIG. 8.

Even if the present invention is in no way directly related to the variation over time (t) (x-axis) of the electrostatic field strength 70, which is indicated as a decaying field strength in FIG. 8, the principal function of the invention will be described.

In FIG. 2 has been introduced as reference numbers "F1", "F2", "F3", "F3'", and "F4", to various field strengths of the different part sections 40", 40*a*, 40' of the substrate, and these have also been introduced into FIG. 8.

Hence, it is clear from FIG. 8 that at the point in time "t0", a maximized field strength prevails from the ionization electrode 33. This field strength decreases, according to a decaying function, to the breaking wheel 21 and there also gives rise to a field strength of F2.

This field strength F2 is additionally reduced along the section 40*a*' to the value F3, under which the parts 2*c*' to 2*c* are cleansed from loose particles "p2" during the time duration between "t1" and "t2". This equals the time that the strip part 40*a* will pass between the breaking rolls 21 and 21*a*.

At the time section "t3", the substrate 40' is deionized and forms a deionized and cleansed substrate 40, which via a renewed ionization of the ionization electrode 33 is prepared for a renewed particle collection along the surface parts 2*c*' and 2*c*.

Practical tests tend to show efficient collection of loose particles "p2" from surface parts 2*c*' to 2*c* at a varying field strength, which can be achieved via different measures but most simply by allowing the variation to follow a decaying function, illustrated in FIG. 8.

Naturally, the invention is not limited to the above, for exemplifying purposes disclosed, embodiment, but can be modified within the scope of the basic idea of the invention, which is illustrated in the enclosed claims.

In particular, it should be considered that each shown unit and/or circuit can be combined with every other shown unit and/or circuit within the scope for reaching a desired technical function.

The invention claimed is:

1. A method comprising:

a first processing step ("S1") of using a substrate (40) in an ionizing state and under an activated electrostatic field strength (70), to collect loose and/or loosened particles ("P2"; "p2") from a surface part (2*c*, 40*a*, 2*c*') supporting the particles, the substrate comprising a piece of flexible sheet material (41) arranged to collect the loose and/or loosened particles ("p2") from the surface part (2*c*, 40*a*, 2*c*') supporting the particles, and a support layer (42) cooperating with and supporting the piece of flexible sheet material (41), the piece of flexible sheet material (41) being impermeable to micro fibers and nano fibers, wherein both the piece of flexible sheet material (41) and the support layer (42) display electrically isolating and are gas and air permeable, wherein during said first processing step, the loose and/or loosened particles ("P2"; "p2") are collected in the flexible sheet material (41); and a second processing step ("S2"), with the substrate being in a deionized state or under a neutral electrostatic field strength, of cleansing the flexible sheet material (41) of the collected loose and/or loosened particles, wherein in the second processing step, the flexible sheet material (41) is cleansed of the collected loose and/or loosened particles, using at least one of i) a generated air stream under an overpressure passing through the substrate (40) in a direction through the support layer (42) and the piece of flexible sheet material (41), and ii) a generated air stream under an underpressure passing through the substrate (40) in a direction through the support layer (42) and the piece of flexible sheet material (41).

2. The method according to claim 1, wherein the piece of flexible sheet material (41) is used as a filter unit (43) which is arranged to collect micro and nano particles, said support layer (42) displays through openings (42*b*) distributed air passages through the piece of flexible sheet material for air streams, under the underpressure or under the overpressure, wherein the total surface share of the openings (42*b*) belonging to the support layer cover at least 50% of the total surface area of the piece of flexible sheet material (41), and wherein the piece of flexible sheet material as well as the support layer are formed from an electrically isolating material.

3. The method according to claim 1, wherein the piece of flexible sheet material is structured with an increased density in the direction of an air passage, with an increased density within a bottom area and bottom extension of the piece of flexible sheet material for collection of micro particles and/or nano particles.

4. The method according to claim 1, wherein the piece of flexible sheet material has a thickness of 2 to 10 mm, while the support layer has a thickness of 1 to 5 mm.

5. A method comprising:

using a substrate (40), within a first processing step ("S1"), collecting loose and/or loosened particles ("P2", "p2") from a surface part (2*c*, 40*a*, 2*c*') supporting the particles, in an ionizing state and under an activated electrostatic field strength (70), and in a second processing step ("S2") cleansing the substrate from collected particles, in a deionized state or under a neutral electrostatic field strength, using a piece of flexible sheet material (41) comprising the substrate (40) and being impermeable to micro fibers and/or nano fibers, and wherein the piece of flexible sheet material (41) as well as its support layer (42) display electrically isolating and gas and air permeable properties, wherein the isolating, gas and air permeable support layer (42) is applied to the surface part of the substrate (40) and its associated piece of flexible sheet material (41) facing away from loose and loosened particles, wherein in the second processing step, the flexible sheet material is cleansed of the collected loose and/or loosened particles, using at least one of i) a generated air stream under an overpressure passing through the substrate in a direction through the support layer and the piece of flexible sheet material, and ii) a generated air stream under an underpressure passing through the substrate in a direction through the support layer and the piece of flexible sheet material.

6. The method according to claim 5, wherein the substrate comprising the piece of flexible sheet material and the support layer for collecting the particles is associated with an electrostatic field, and the electrostatic field has an adapted variable field strength (70) acting in relation to the loose and/or loosened particles, in order to collect the particles within the piece of flexible sheet material (41) by an attractive force adapted to the electrostatic field strength, acting on said loose and/or loosened particles.

7. The method according to claim 5, wherein the particles collected by attracting forces in a deionized state are removed using at least one air jet formed by an underpressure and/or an overpressure.

8. The method according to claim 5, wherein, before the collecting of loose and/or loosened particles in said first processing step ("S1"), the substrate (40, 40", 40') is ionized and associated with the activated electrostatic field strength (70), and immediately after the collection and storing of the loose and/or loosened particles within the piece of flexible sheet material, the substrate (40, 40", 40') is allowed to deionize the piece of flexible sheet material, the support layer and the particles to thereafter cleanse the piece of flexible sheet material from thus collected and neutralized particles.

9. The method according to claim 5, wherein the field strength (70) for the electrostatic field for a planar particle supporting surface part and a planar and parallel oriented substrate (40) is selected according to a decaying function or following a decaying function.

10. The method of claim 5, wherein in the second processing step ("S2") of cleansing the substrate from collected particles, the generated air stream, under the overpressure, is passed through the substrate, in the deionized state, in the direction through the support layer and the piece of flexible sheet material to thereby cleanse the flexible sheet material by blowing away deionized particles collected within the piece of flexible sheet material.

11. The method of claim 5, wherein in the second processing step ("S2") of cleansing the substrate from collected particles, the generated air stream, under the underpressure, is passed through the substrate, in the deionized state, in the direction through the support layer and the piece of flexible sheet material to thereby cleanse the flexible sheet material by blowing away deionized particles collected within the piece of flexible sheet material.

* * * * *